United States Patent [19]

Benson et al.

[11] 3,964,338

[45] June 22, 1976

[54] POLE UNIT MECHANISM FOR CLOSING THE CONTACTS IN AN OIL CIRCUIT BREAKER

[75] Inventors: John C. Benson, Hyde Park; George L. Hossfield, Jr., Walpole, both of Mass.

[73] Assignee: Allis-Chalmers Corporation, Milwaukee, Wis.

[22] Filed: Apr. 10, 1974

[21] Appl. No.: 459,846

[52] U.S. Cl. ..... 74/520; 200/150 R

[51] Int. Cl.[2] ..... G05G 1/04

[58] Field of Search ..... 74/25, 38, 519, 520, 74/522, 522.5, 524, 525; 200/150

[56] References Cited

UNITED STATES PATENTS 2,357,603 9/1944 Pinkham et al. ..... 200/150

3,187,593 6/1965 McCloud ..... 74/520 X

*Primary Examiner*—Samuel Scott
*Assistant Examiner*—Frank H. McKenzie, Jr.
*Attorney, Agent, or Firm*—Robert C. Jones

[57] ABSTRACT

A circuit breaker of the oil type having an operating mechanism for providing an improved force operation of the contact lift rod. The mechanism includes a linkage arrangement with a scissor-type toggle to provide a mechanical advantage for increasing the force for closing the contacts. In addition, the improved pull rod mechanism is particularly well adapted for location in relatively small enclosures.

6 Claims, 4 Drawing Figures

POLE UNIT MECHANISM FOR CLOSING THE CONTACTS IN AN OIL CIRCUIT BREAKER

BACKGROUND OF THE INVENTION

Actuators for the lift rods of circuit breaker contacts have in the past been relatively large mechanisms having slow time response. These large mechanisms have been necessary to overcome all the resisting forces that are encountered in a closing operation. Such forces result from the tail springs which are inside of the circuit breaker, the oil pumps, the friction of the tulip contacts and even the magnetic forces which occur when prestrike occurs. The large mechanism, such as depicted in U.S. Pat. No. 2,357,603, exemplifies the size and the space requirement that it has been necessary to provide for circuit breaker structures. In the past, in an effort to reduce the size of the toggle actuating mechanism and increase the efficiency of the actuators an overcenter five-bar toggle link arrangement has been provided in the circuit breakers. However, the five-bar arrangement is expensive and still requires more space than is practical or permissible and, of course, complicates circuit breaker design as well as increasing manufacturing costs. Thus, improvements which will materially reduce the size and complexities of component mechanisms that are required and at the same time increase the operating efficiency are an additional step forward.

SUMMARY OF THE INVENTION

Accordingly, it is an object of the invention to provide a toggle actuating mechanism for the contact lift rod of an oil type circuit breaker which has increased efficiency and which is capable of being enclosed in a relatively small space.

The present invention includes a linkage mechanism operatively connected to effect the axial movement of a contact lift rod for effecting the closing and opening of oil submerged contacts. The linkage mechanism is actuated through a forcecoupled, two-link scissor-type toggle which provides an additional mechanical advantage to the contact closing operation. An input lever or crank is connected to actuate the scissor toggle and is operatively connected thereto through a slot and pin arrangement to provide flexibility and to provide an additional mechanical advantage. Actuation of the pole mechanism is accomplished from an operator output crank connected by a motion bar to a bellcrank located exteriorly of the pole mechanism.

DESCRIPTION OF THE INVENTION

Figure 1:
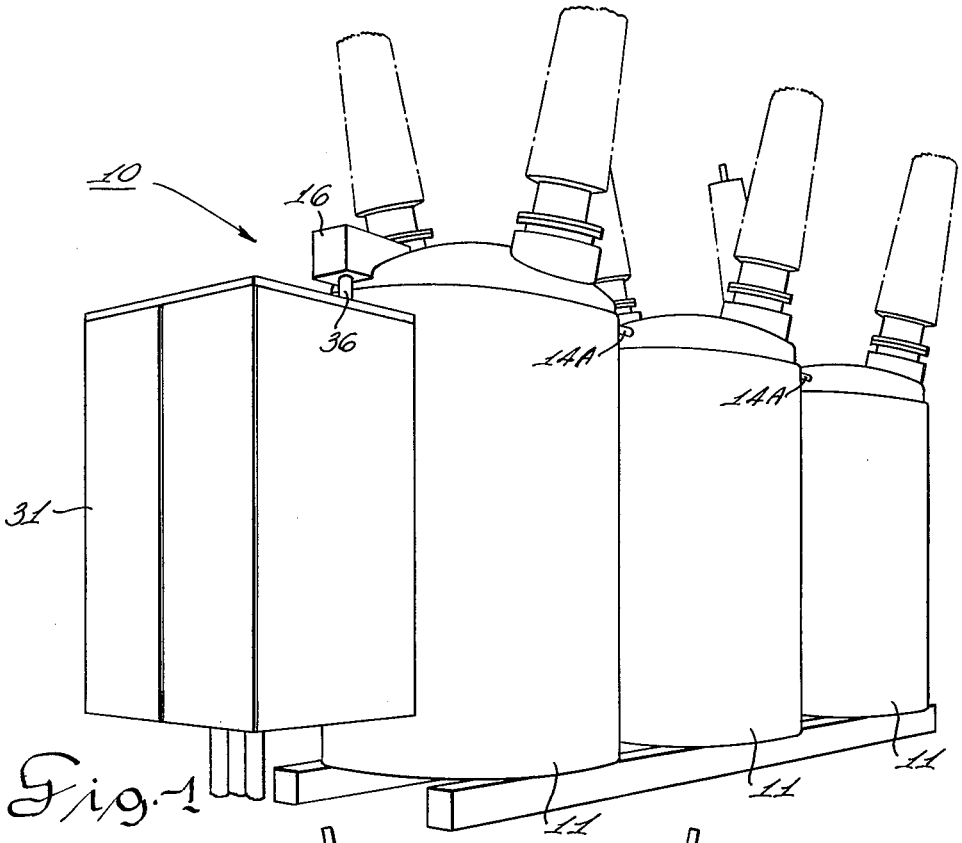
FIG. 1 is a perspective view of a three-pole oil circuit breaker incorporating the teaching of the present invention.
Figure 2:
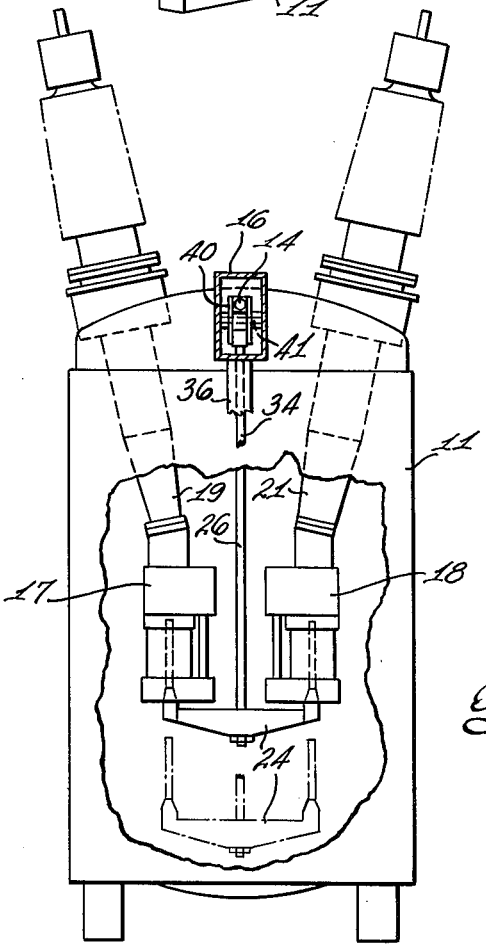
FIG. 2 is a view of one of the pole units of FIG. 1 with the wall portion broken away.

As shown in FIG. 1, the oil circuit breaker 10 is a three-pole breaker and each pole is housed in a receptacle or tank 11 that is substantially filled with oil. A common pull rod mechanism 14 extending horizontally through the upper portion of pole mechanism housings 16 is provided for effecting the operation of the movable contact structure 24 in each of the tanks 11. The contact structure 24 of each of the pole units includes stationary contact means 17 and 18 rigidly secured to the lower ends of the bushings 19 and 21 and a cooperable movable bridging contact member 24 that is rigidly secured to the lower end of a lift rod 26. The upper end of the lift rod 26 is pivotally connected to drive means generally indicated at 30. Operation of the drive means 30 is effected by means of a suitable power operating and tripping means (not shown) located within an end cabinet 31. The power operating mechanism (not shown) located within the cabinet 31 has an operative connection with a pivotally displaceable crank 33 also located within the cabinet 31. The free end of the crank 33 is pivotally connected to the lower end of a vertically extending motion transmitting rod 34 that is enclosed in the suitable conduit 36 extending between the end cabinet 31 and the pole unit housing enclosure 16. The upper end of the rod 34 extends into the pole unit enclosure 16 and is pivotally connected as at 38 to one arm of a bellcrank 40. The bellcrank 40 is pivotally connected as at 41 to a fixed abutment or plate 42 located within the housing 16. The opposite arm of the bellcrank 40 is pivotally connected as at 43 to the end of the pull rod 14. As previously mentioned, the pull rod 14 extends horizontally across the top of each oil tank through each pull rod mechanism enclosure for actuating the contact of each oil circuit breaker. Each lift rod contact operating mechanism 30 associated with each circuit breaker tank 11 is operated simultaneously. Thus, the description given for one operating mechanism 30 will apply to all mechanisms.

Figure 4:
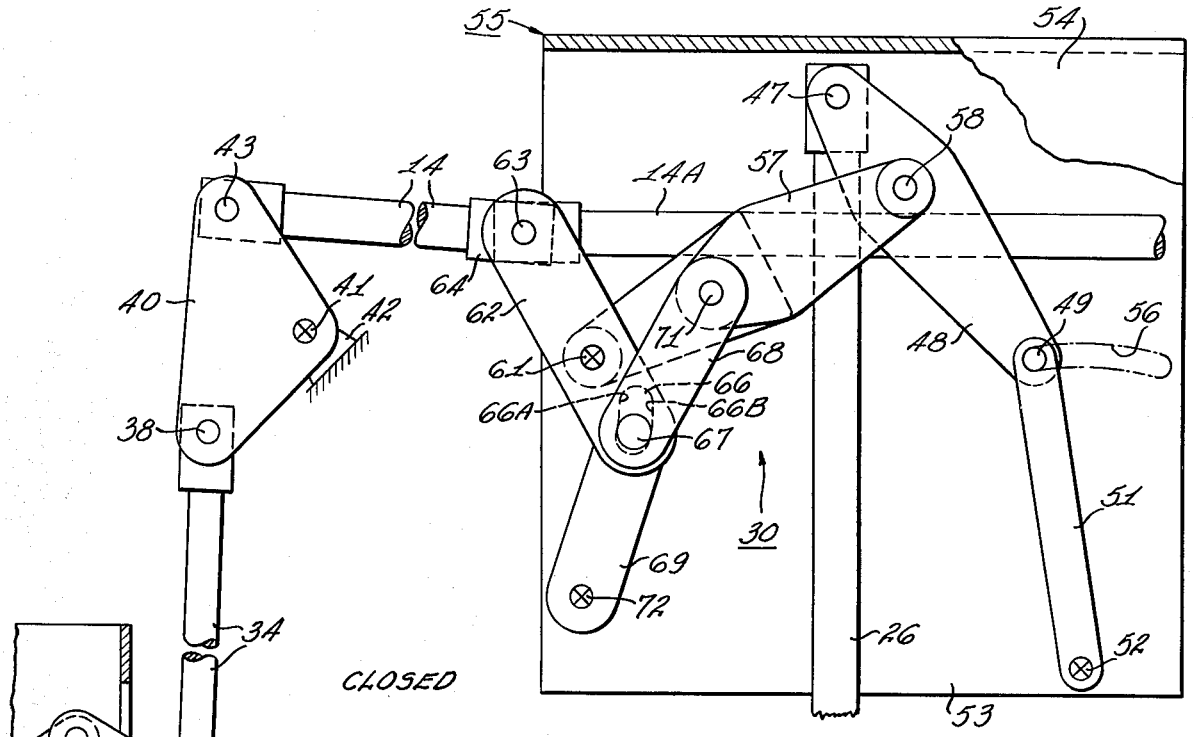
FIG. 4 is a view similar to that of FIG. 3, but showing the pole mechanism in breaker open condition.
Figure 3:
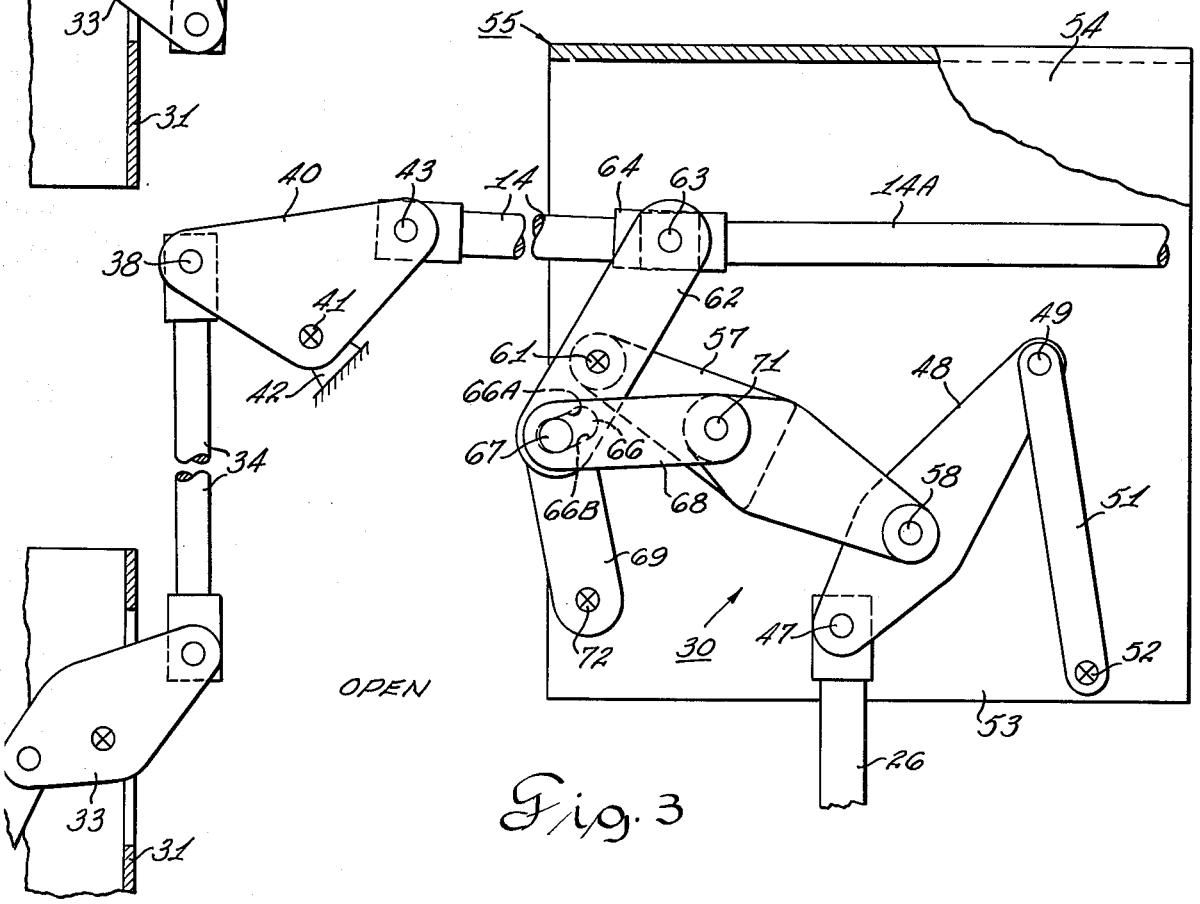
FIG. 3 is an enlarged fragmentary view of a pole unit operating mechanism for actuating the contact lift rod, the showing being made in breaker closed condition.

As shown in FIGS. 3 and 4, the upper end of the lift rod 26 is pivotally connected as at 47 to one end of the compensating arm 48. The opposite end of the compensating arm 48 has a pivotal connection as at 49 to a swing link 51 that is pivotally secured to a fixed pivot pin 52 carried by the side walls 53 and 54 of a frame member 55 located within the pole unit enclosure 16. In FIGS. 3 and 4, the side wall 54 has been omitted to more clearly show the mechanism. A second or power arm 57 has one end thereof pivotally secured as at 58 to the compensating arm 48. The opposite end of the second arm 57 has a pivotal connection with a fixed pin 61 which is carried in the side walls 53 and 54. The articulated connection effected between the power arm 57 and the upper end of the lift rod 26 through the compensating arm 48 provides a unique arrangement for applying the force from the power arm 57 to the lift rod 26 and also to maintain the lift rod 26 in a straight line as the arm 57 moves the lift rod 26 either upwardly to a breaker closed position or downwardly to a breaker open position. It will be appreciated that if there is no requirement for maintaining the lift rod 26 in a straight line as it is moved axially, then the end of the arm 57 that is shown pivotally connected to the compensating arm 48 at 58 can be pivotally connected directly to the upper end of the lift rod 26.

It will also be appreciated that is lieu of the swing link 51 other construction can be provided for providing the necessary lateral adjustment for the compensating arm 48 for maintaining a straight line path of travel for the lift rod 26. For example, the side walls 53 and 54 can be provided with slightly arcuate horizontally extending slots 56 in which the pivot pin 49 would be disposed for horizontal movement. With this arrangement, the lower end of the compensating arm will be connected to the pin 49 as it is to the upper end of the swing link 51 and thus will be adjustable laterally with respect to the lift rod 26 so that no lateral force will be applied to the lift rod 26 to displace it from its straight line path of travel.

The pin 61 also supports a crank or lever 62, one end of which is pivotally connected as at 63 to a flexible joint assembly 64 that is provided between the external portion of the rod 14 and that portion of the rod 14A which extends into the pole unit enclosure 16. The lever or crank 62 is provided with an opening or slot 66 which receives the extending end of a pin 67. The pin 67 pivotally connects the two adjacent ends of a pair of links 68 and 69 of a two-bar scissor toggle constituting a force-coupling arrangement. The link 68 has a pivotal connection as at 71 with the second arm 57. The point of connection of the link 68 with the second arm 57 is determined by the relationship between the load on second arm 57 and the available force of the scissor toggle. On the other hand, the link 69 has a pivotal connection with a fixed pivot 72 that is carried by the side plates 53 and 54.

An operational sequence will be described and for this purpose, it will be assumed that the circuit breaker is in open position wherein the linkage of the drive mechanism 30 and the associated operating mechanism will be in the positions as indicated in FIG. 3. Under this assumed condition, the movement of the contact from an open to a closed position will be effected in the following manner.

When the operator crank 33 is pivotally moved downwardly from the position that it occupies in FIG. 3 to the position that it occupies in FIG. 4, the vertical motion transmitting rod 34 will cause the bellcrank 40 to pivot in a counterclockwise direction about the fixed pivot 41. As a result, the bellcrank 40 will move from the position shown in FIG. 3 to the position shown in FIG. 4 and in doing so will cause the rod 14 and the associated rods 14A to move leftwardly with it. Leftward movement of the rod 14 will cause the lever 62 to pivot about the pivot pin 61. The lever 62 pivoting on the fixed pivot pin 61 will cause the side wall or surface 66A of the opening or slot 66 to engage with the pin 67 forcing the links 68 and 69 of the scissor toggle to spread. That is, the lever 62 through the cooperative operation of the slot 66 and pin 67 acts on the link 69 forcing the link 69 to pivot in a clockwise direction about the pin 72. This movement, in turn, forces the link 68 to pivot in a counterclockwise direction about the pin 67. Since the right end of the arm 57, as viewed in FIG. 3, is pivotally connected to the compensating arm 48 at 58, the arm 48 will be forced upwardly, lifting the rod 26 and thereby moving the contacts 24 to closed position. As the compensating arm 48 rotates in a clockwise direction about the pin 49 in a breaker closing direction, the swing link 51 permits a lateral adjustment to take place in the position of the compensating arm. This is true because as the compensating arm 48 rotates clockwise about pin 49, the swing link 51 rotates first in a clockwise direction and then in a counterclockwise direction about the pin 52. The compensating arm 48 therefore moves bodily rightwardly, then leftwardly during the breaker closing operation. Thus, no strain nor lateral displacement is placed on the rod 26 in moving the lift rod 26 from the open to closed position.

The wall surface 66A cooperates with the pin 67 to effect the displacement of the links 68 and 69 away from each other in a contact closing operation. On the other hand, the wall surface 66B cooperates with the pin 67 to effect a displacement of the links 68 and 69 toward each other in a contact opening operation. Thus, the slot 66 is formed in the end of the lever 62 in a manner that the wall surfaces 66A and 66B are generated so that these surfaces, depending upon whether the lever 62 is being operated in a contact closing or a contact opening operation, will be continuously perpendicular to a bisector of the angle between the links 68 and 69 of the scissor toggle.

The circuit breaker is opened by operation of a stored energy device (not shown), such as springs, which are operatively connected to the pull rod mechanism 14. When the stored energy device (not shown) is released, it operates to move the pull rod mechanism 14 in a rightwardly direction as viewed in FIG. 4. This rightward movement of the pull rod mechanism 14 operates to effect the movement of the lever 62 to pivot in a clockwise direction on the pin 67. As a result, the wall surface 66B of the slot 66 forcefully engages the pin 67, and the links 68 and 69 will be displaced towards each other drawing the scissor toggle together. As a result of the collapse of the scissor toggle, the arm 57 pivoting about the pin 61 will pull the compensating arm 48 in a counterclockwise direction about the pin 49. This counterclockwise pivotal movement of the compensating arm forces the lift rod 26 downwardly thereby opening the bridging contacts 24. As the compensating arm 48 pivots in an opening movement, the swing link 51 pivots about the pin 52 thereby maintaining the compensating arm in straight line driving engagement with the lift rod 26.

The embodiments of the invention in which an exclusive property or privilege is claimed are defined as follows:

1. In a circuit breaker having stationary contacts and movable contacts movable into and out of engagement with said stationary contacts;

a frame;

a lift rod operably connected to effect the movement of said movable contacts into and out of engagement with said stationary contacts;

linkage mechanism supported by said frame and operatively connected to said lift rod;

a swing link operatively connected to provide for an adjustment in the linkage mechanism so that laterally acting forces are not applied to said lift rod as it is moved in a contact closing operation;

operating means remote from said lift rod to effect the operation of said lift rod;

interconnecting means operatively connecting said operating means with said lift rod;

a force-coupled mechanism comprising a scissor-toggle supported by said frame and operatively connected to said linkage mechanism and to said interconnecting means, said scissor-toggle including a first link and a second link, said links each having first and second ends;

a common pivot pin to which the first ends of said first and second links are pivotally connected;

a first fixed pivot pin carried by said frame to which the second end of said first link is pivotally connected;

a pivot pin carried by said linkage mechanism to which the second end of said second link is pivotally secured;

an adjusting guide means on said frame operably connected to provide limited lateral adjustment in said linkage mechanism and operable to effect the axial movement of said lift rod in a straight line path of travel as it is moved axially; and, an input lever pivotally supported on said frame and operatively connected to said scissor-toggle and to said interconnecting means;

whereby the operation of said operating means is transmitted to said input lever through said interconnecting means and said input lever operates said scissor-toggle to actuate said linkage mechanism to effect a forceful movement of said contacts to a closed or open position.

2. A circuit breaker according to claim 1 wherein said linkage mechanism comprises a power arm having a first end pivotally mounted on the fixed pivot pin carried by said frame about which said lever pivots;

a compensating arm having a first end pivotally connected to the free end of said lift rod, said power arm having a second end pivotally connected to said compensating arm at a point between its ends;

said adjusting guide means is a swing link having a first end pivotally connected to a second fixed pivot carried by said frame in a manner that the second end of said swing link is movable in a plane transverse to the plane in which said lift rod is movable; and, said compensating arm having its second end pivotally connected to the second end of said swing link.

3. In an operating mechanism for effecting the movement of a movable member between two positions;

a rod having one end connected to said movable member to effect movement;

a power arm having a first end and a second end, said first end being pivotally connected to a fixed pivot pin;

articulation means connecting the second end of said power arm to the free end of said rod;

a compensating arm having a first end pivotally connected to the free end of said rod;

a swing link having one end pivotally connected to a fixed pivot point for pivotal swing movement in a plane transverse to the plane in which said rod is movable, the opposite end of said swing link being pivotally secured to the second end of said compensating arm whereby the axial movement of said rod is maintained in a substantially straight line path of travel;

an adjustable pivot to which the second end of said compensating arm is pivotally connected, said adjustable pivot being constructed and arranged to permit said second end of said compensating arm to move laterally with respect to the axial direction of movement of said rod;

said power arm having its second end pivotally secured to said compensating arm;

drive means movable to different positions for actuating said power arm; and, connecting means for force-coupling said drive means to said power arm.

4. An operating mechanism according to claim 3 wherein said connecting means for force-coupling said drive means to said power arm is a scissor toggle; and, there is provided a lever having first and second ends, said lever having its first end pivotally connected to said drive means, said lever having its second end operatively connected to said scissor toggle in a manner to operate said scissor toggle to apply a force to said power arm.

5. An operating mechanism according to claim 4 wherein said scissor toggle includes a first link and a second link, said links having first and second ends, said links having their first ends pivotally connected to a common pivot pin, said first link also having its second end pivotally connected to a fixed pivot, said second link also being pivotally connected to said power arm; and, wherein the second end of said lever is pivotally connected to the common pivot pin to which the first ends of said first and second links of said scissor toggle are connected;

whereby the operation of said drive means exerts a force on the first end of said lever and said second end of said lever forcefully operates said scissor links to transmit a force to said power arm for moving said rod axially to thereby effect the movement of said movable member.

6. An operating mechanism according to claim 5 wherein said second end of said lever is provided with an opening which receives the common pivot pin to which the first ends of said first and second links of said scissor toggle are pivotally connected, said opening being constructed and arranged in a manner that the working surfaces of said opening are generated so that as said lever operates the one or the other of said wall surfaces of said slot is maintained at all times perpendicular to a line which bisects the angle between said first and second links of said scissor toggle.

* * * * *